US010420371B2

(12) United States Patent
Besson et al.

(10) Patent No.: US 10,420,371 B2
(45) Date of Patent: Sep. 24, 2019

(54) POUCH FOR TOBACCO WITH REVERTABLE POCKETS

(71) Applicants: REEMTSMA CIGARETTENFABRIKEN GMBH, Hamburg (DE); Peter Besson, Nottingham (GB); Edward Cooper, Hamburg (DE)

(72) Inventors: Peter Besson, Nottingham (GB); Edward Cooper, Hamburg (DE)

(73) Assignee: REEMTSMA CIGARETTENFABRIKEN GMBH, Hamburg (DE)

( * ) Notice: Subject to any disclaimer, the term of this patent is extended or adjusted under 35 U.S.C. 154(b) by 0 days.

(21) Appl. No.: 15/543,828

(22) PCT Filed: Jan. 15, 2016

(86) PCT No.: PCT/EP2016/050737
§ 371 (c)(1),
(2) Date: Jul. 14, 2017

(87) PCT Pub. No.: WO2016/113380
PCT Pub. Date: Jul. 21, 2016

(65) Prior Publication Data

US 2017/0347703 A1 Dec. 7, 2017

(30) Foreign Application Priority Data

Jan. 16, 2015 (EP) ..... 15151433

(51) Int. Cl.
*A24F 23/02* (2006.01)
*B65D 30/22* (2006.01)

(52) U.S. Cl.
CPC ..... *A24F 23/02* (2013.01); *B65D 31/12* (2013.01)

(58) Field of Classification Search
CPC ..... A24F 23/02; A24F 23/00; B65D 33/30; B65D 33/16; B65D 31/21
(Continued)

(56) References Cited

U.S. PATENT DOCUMENTS 437,042 A * 9/1890 Peck ..... B65D 5/5253 229/120.09
1,824,491 A * 9/1931 Molins ..... B65D 5/38 206/256
(Continued)

FOREIGN PATENT DOCUMENTS

DE 3721675 A1 1/1989
EP 0452167 A1 10/1991
(Continued)

OTHER PUBLICATIONS

European Search Report for EP 15151433.8 dated Jul. 7, 2015, 6 pages.
(Continued)

*Primary Examiner* — Chun Hoi Cheung
(74) *Attorney, Agent, or Firm* — Workman Nydegger

(57) ABSTRACT

A pouch for tobacco with revertable pockets, wherein the pouch comprises a first pocket comprising a front wall, a back wall, a first opening and a flap formed by an elongated part of the back wall to close the first opening; a second pocket comprising a front wall, a back wall and a second opening; wherein the first and the second pocket are connected to each other along a reverting line such that the first pocket and the second pocket are foldable relative to each other along said reverting line in order to revertably oppose the front walls of the first and second pocket or to oppose the back walls of the first and second pocket.

11 Claims, 2 Drawing Sheets

Figure 1:
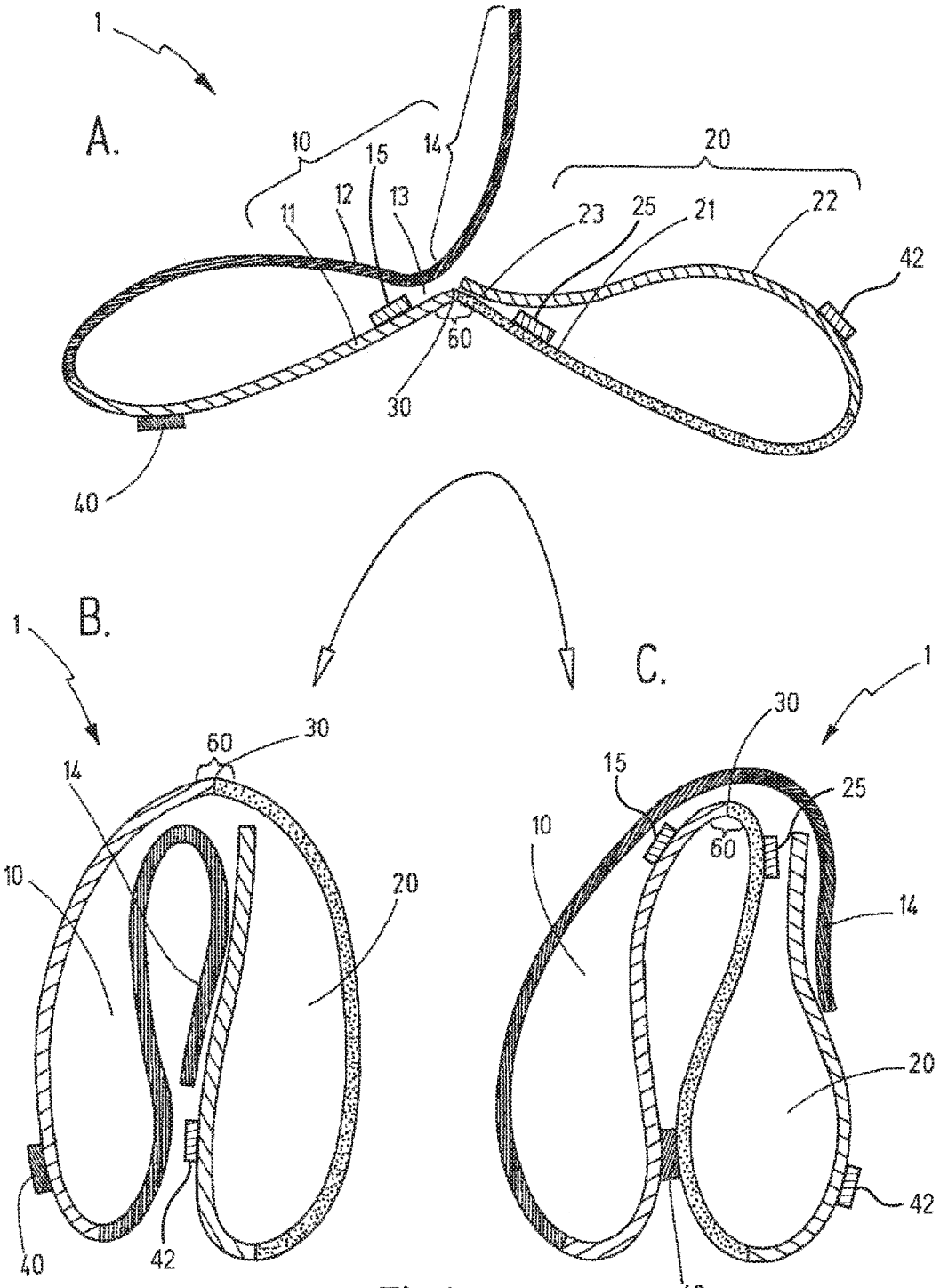

(58) Field of Classification Search
USPC ..... 206/260, 236, 238, 239; 383/38–40, 84, 383/260, 236, 238, 239
See application file for complete search history.

(56) References Cited

U.S. PATENT DOCUMENTS

RE21,887 E * 8/1941 Klein ..... A24F 23/02 206/260
2,537,196 A 1/1951 Tanski
3,387,640 A * 6/1968 Butler ..... A24F 23/02 206/245
3,394,870 A 7/1968 Curtis
3,471,005 A * 10/1969 Sexstone ..... A24F 23/02 206/260
4,793,487 A * 12/1988 Bentsen ..... B65D 33/001 206/451
5,893,514 A * 4/1999 Fletcher ..... B65D 27/34 229/309
5,941,641 A * 8/1999 Kinigakis ..... A24F 23/02 206/260
8,141,707 B2 * 3/2012 Robbins ..... B65D 5/545 206/447
8,763,890 B2 * 7/2014 Clark ..... B32B 3/085 206/813
2003/0029745 A1 2/2003 Staiano
2013/0327820 A1 * 12/2013 Clark ..... B65D 5/0085 229/120.37
2015/0160852 A1 * 6/2015 Choi ..... G06F 3/04883 345/467

FOREIGN PATENT DOCUMENTS

GB 12504 5/1913
GB 622766 A 5/1949
NZ 544504 A 4/2007
WO 98/54060 A1 12/1998

OTHER PUBLICATIONS

International Search Report and Written Opinion for PCT/EP2016/050737 dated Mar. 17, 2016, 12 pages.
Office Action in corresponding Australian Application 2016208024 dated Oct. 5, 2018, 3 pages.
Office Action in the corresponding New Zealand application 733482 dated Mar. 15, 2019, 3 pages.

* cited by examiner

POUCH FOR TOBACCO WITH REVERTABLE POCKETS

CROSS-REFERENCE TO RELATED APPLICATIONS

This application is a Nationalization of PCT Patent Application Serial No. PCT/EP2016/050737 filed on Jan. 15, 2016, entitled "A Pouch for Tobacco with Revertable Pockets," which claims priority to European Patent Application 15151433.8, filed Jan. 16, 2015, which applications are expressly incorporated herein by reference in their entirety.

The present invention is directed to a pouch for tobacco comprising at least two pockets, wherein said pockets are revertable to allow the consumer switching between outer surfaces of the pockets to be exposed.

In the prior art, pouches for tobacco with multiple pockets are well known. E.g. pouches with two pockets are known wherein the two pockets are neighbored side by side so that the openings of the two pockets are aligned and accessible from the same direction; exemplary embodiments of pouches of the prior art are disclosed in U.S. Pat. Nos. 3,394,870 and 2,537,196.

The space available for information or marketing purposes on such pouches for tobacco is limited and it is desirable to provide additional opportunities for communication with the consumer.

It is an object of the present invention to provide a pouch for tobacco with improved opportunities for communication with the consumer.

The present invention provides a pouch for tobacco with revertable pockets, wherein the pouch comprises a first pocket comprising a front wall, a back wall, a first opening and a flap formed by an elongated part of the back wall to close the first opening; a second pocket comprising a front wall, a back wall and a second opening; wherein the first and the second pocket are connected to each other along a reverting line such that the first pocket and the second pocket are foldable relative to each other along said reverting line in order to revertably oppose the front walls of the first and second pocket or to oppose the back walls of the first and second pocket.

Alternatively, the pouch of the invention lacks a flap formed by an elongated part of the back wall to close the first opening. The pouch of the invention may be free of any flap.

The pouch of the present invention comprises at least a first and a second pocket. Further, the pouch may comprise additional pockets.

The first pocket comprises at least a front wall, a back wall and a first opening. In addition to the front and back wall, the first pocket may comprise one or more additional walls like side and/or bottom walls in order to define the pocket. Front wall and back wall limit the pocket against the environment, wherein the interior of the first pocket is accessible via the first opening.

The pouch further comprises a second pocket, wherein the second pocket may resemble the first pocket or may differ from the architecture of the first pocket. However, the second pocket comprises at least a front wall, a back wall and a second opening. In addition to the front and back wall, the second pocket may comprise one or more additional walls like side and/or bottom walls in order to define the pocket. Front wall and back wall limit the pocket against the environment, wherein the interior of the second pocket is accessible via the second opening.

The first pocket and the second pocket are connected to each other along a reverting line. First and second pocket are connected by a physical connection, preferably first and second pocket are formed integrally as one piece. In one embodiment, the connection between the first pocket and the second pocket can be represented by a base bridging an edge portion of the front walls of the first and second pockets defining the first and second opening respectively.

The reverting line is positioned along the connection between the first and second pocket. The reverting line represents a virtual line defining a hinge along which the first pocket and the second pocket are foldable relative to each other. By folding along the reverting line, the first pocket is movable relative to the second pocket such that either the front walls of the first and second pocket are opposed to each other or the back walls of the first and the second pocket are opposed to each other. In the present invention the expressions "opposed to each other" and "facing each other" have the same meaning and are used interchangingly. If two walls are opposed to each other or are facing each other, the outer surfaces of said walls are oriented towards each other in a substantially parallel orientation, wherein said outer surfaces of the walls may be in direct contact with each other or not. In the pouch of the present invention between two walls which are opposing each other there may be further structures present like e.g. a flap or the like or there may be no further structures present between the two opposing walls.

If the front walls of the first and second pocket are opposed to each other, the outer surface of the front wall of the first pocket faces the outer surface of the front wall of the second pocket. In this folding configuration, the outer surfaces of the front walls of the first and second pocket are partially or fully covered by one other and, to the extent covered, not visible from the outside of the pouch, whereas the outer surfaces of the back walls of the first and second pocket are exposed and visible to the consumer.

However, if the back walls of the first and second pocket are opposed to each other, the outer surface of the back wall of the first pocket faces the outer surface of the back wall of the second pocket. In this folding configuration, the outer surfaces of the back walls of the first and second pocket are partially or fully covered by one another and, to the extent not covered, not visible from the outside of the pouch, whereas the outer surfaces of the front walls of the first and second pocket are exposed and visible to the consumer.

By folding the pouch of the present invention along the reverting line, the first and second pockets are reverted relative to each other and the outer surfaces visible to the consumer are switched between outer surfaces of the front walls of the first and second pocket and outer surfaces of the back walls of the first and second pocket. Further, depending on the folding configuration of the pouch also the outer surface of the flap is either visible to the customer or not. Thus, with the pouch of the present invention, the space available for branding, information and marketing purposes is enlarged; the opportunities for communication with the consumer are improved.

In the pouch of the invention, the outer surfaces of the front and back walls of the first and second pockets are available for consumer communication. Depending on how the pouch is folded along the reverting line, either the outer surfaces of the front walls of the first and second pockets are exposed and visible to the consumer or the back walls of the first and second pockets. Consequently, all four outer surfaces of the front and back walls of the first and second pocket of the pouch are available for communication with the consumer. Depending on the folding state along the reverting line, the consumer has the choice which outer surface he wants to have exposed during use of the pouch.

The pouch of the invention allows marketing and selling the pouch in a first folding configuration and, after purchase, the consumer may switch the pouch along the reverting line to a second folding configuration for use in order to expose a so far unexposed, "fresh" surface. By doing so, the consumer is enabled to enjoy a so called "untouched" surface effect, wherein, after purchase, the consumer may choose to use the pouch with a so far unexposed visible surface and outer appearance.

During manufacturing, delivery, presentation and purchase, the outer surface of the pouch may be impaired e.g. by pollution or scratching. By folding the pouch along the reverting line, the consumer can uncover so far unexposed surfaces and use the pouch with an unimpaired outer appearance.

Further, the pouch of the invention allows stepwise communication with the consumer. The outer surface of the front and/or back walls of the first and second pocket may be designed such that the consumer is confronted with a first message in a first folding state, e.g. the consumer is confronted with a question, and by switching the pouch along the reverting line, the consumer is confronted with a second message which is related to the first message, e.g. an answer to said question.

Preferably, the pouch further comprises one or more first releasable adhesive means on at least one of the front walls of the first and/or second pocket. The first adhesive means are arranged and executed in order to allow non-permanent, releasable and resealable fixing of one folding state along the reverting line. The first releasable adhesive means allows releasably fixing the front walls of the first and second pocket in a position opposing each other. By doing so, the back walls of the first and second pocket are exposed and outer surfaces of the back walls are visible to the consumer.

In addition or alternatively to first releasable adhesive means, the pouch may further comprise one or more second releasable adhesive means on at least one of the back walls of the first and second pocket. The second adhesive means are arranged and executed in order to allow non-permanent, releasable and reseal able fixing of one folding state along the reverting line. The second releasable adhesive means allows releasably fixing the back walls of the first and second pocket in a position opposing each other. By doing so, the front walls of the first and second pocket are exposed and outer surfaces of the front walls are visible to the consumer.

First and/or second releasable adhesive means encompass means which are suitable to fix the pouch in a given folding state by non-permanently attaching the front or back walls of the first and second pocket to each other respectively. The skilled person is well aware of various means suitable for use as first and/or second releasable adhesive means. The releasable adhesive means encompass means which are arranged only on one wall like e.g. a strip of a releasable adhesive, as well as means which require the presence of appropriate structures on both walls to be fixed, like e.g. hook-and-loop/Velcro fastener, press-button, snap-button and releasable adhesive including a suitable landing zone. The first and/or second releasable adhesive means may e.g. be represented by one of a hook-and-loop/Velcro fastener, a press-button, a snap-fastener and a releasable adhesive. Preferably, the first and/or second releasable adhesive means comprises a releasable adhesive. The skilled person is well aware of various adhesives suitable for releasably fixing outer surfaces of pouches. In the prior art suitable releasable adhesives are known. Among others, a pressure sensitive adhesive (PSA) can be used as releasable adhesive. A PSA will seal or adhere two surfaces, but allows their separation and later re-adherence. In particular, the first and/or second releasable adhesive means comprises a pressure sensitive adhesive.

The first and second releasable adhesive means may be of the same or of different kind.

By using first and/or second adhesive means, the pouch of the invention can be fixed in a preferred folding state for a given period of time and, when desired, the pouch can be reverted into another folding state and may be fixed again.

Preferably, the first and/or second releasable adhesive means or parts thereof are covered by protection means in order to protect the first and/or second releasable adhesive from damage, unintentional sticking or contamination. Upon removal of said protection means, the first and/or second releasable adhesive means or parts thereof are exposed and available for use. The protection means preferably comprise a peelable strip, wherein, upon peeling off the strip, the first and/or second releasable adhesive means is available for fixing the front or back walls of the first and second pocket in an opposing position respectively.

The architecture of the pouch of the present invention is not limited to a certain arrangement of first and second pocket, provided that first and second pocket are connected to each other along a reverting line.

In one embodiment, the first and the second pockets are connected to each other such that the first opening and the second opening are aligned to neighbor each other and are both closable by the flap of the first pocket when the front walls of the first and the second pocket oppose each other. In such an arrangement, first and second openings are oriented in parallel to each other and are accessible independently from each other from the same direction. In this embodiment, the first pocket and the second pocket are connected along the reverting line by a base bridging an edge portion of the front walls of the first and second pocket defining the first and second opening respectively.

Optionally, the first and/or the second pocket further comprises a temporary seal, which may be resealable or not, arranged to seal the first or second opening of the first or second pocket respectively.

The pouch of the present invention comprises a first pocket with a flap to close the first opening of the first pocket. Optionally, the flap comprises closing means like e.g. an adhesive tab to releasably close the first opening when the front walls of the first and the second pocket oppose each other. Preferably, the pouch is arranged such that the first opening and the second opening are closable simultaneously by sealing the flap of the first pocket against an outside surface of the pouch. Preferably the pouch is arranged such that the first opening and the second opening are closable simultaneously by sealing the flap of the first pocket against an outside surface of the back wall of the second pocket.

The pouch of the present invention preferably comprises a flap of the first pocket which is arranged to be sealable against an outside surface of the back wall of the second pocket. In order to achieve this, the flap may exhibit a height Hf which does not exceed a height H2 of the second pocket. The heights Hf, H1 and H2 are measured as set out in FIG. 2.

In a preferred embodiment of the pouch of the invention a height H10*f* the first pocket substantially equals a height H2 of the second pocket. In such a configuration the first and second pocket exhibit substantially the same height and outer surfaces of opposing walls of the first and second pocket cover one another fully or substantially fully.

Alternatively, the pouch of the invention may be arranged such that a height H10*f* the first pocket differs from a height H2 of the second pocket. In such a configuration the first and second pocket exhibit a height that differs from each other and outer surfaces of opposing walls of the first and second pocket cover one another only partially depending on the folding state. Thus, if the height H1 differs from the height H2, the pouch of the present invention when presented in a given folding state exhibits a stepped outer surface. Such a stepped outer surface can be used as further opportunity to communicate with the consumer. It will be possible to design the outer surfaces of the first and second pocket in such a way that the pouch exhibits a certain expression only when the pouch is in a particular reverted state. By folding the first pocket relative to the second pocket, a stepped surface is created which allows conveying a certain impression, information or message to the consumer.

In a further preferred embodiment, a height H10*f* the first pocket exceeds a height H2 of the second pocket. By doing so, it is ensured that when the pouch is folded in a configuration where the front walls of the first and second pocket oppose each other, a stepped surface is visible to the consumer. In this embodiment, preferably, the height H2 of the second pocket exceeds a height Hf of the flap. By doing so the stepped surface exhibits two steps which allows for a multitude of design options for communication with the consumer.

The pouch of the invention may comprise further openings, pockets and/or flaps which are either exposed or covered by reverting the first and second pocket relative to each other.

The pouch of the invention may be manufactured by using one or more flexible sheets according to manufacturing processes and methods known in the art. Preferably, the pouch of the present invention is formed of a single blank, a single flexible sheet which is folded and welded to form the first and second pocket of the pouch.

Optionally, the pouch of the invention is formed of a flexible sheet material. The flexible sheet material preferably comprises or consists of:

a polymer, preferably a plastic polymer like e.g. a polyolefine, polyethylene, polyester or methylized polyester;

a metal, a metal alloy, a metal foil and/or a metallized laminate;

a paper;

or a combination thereof.

The flexible sheet material may comprise or consist of a polymer having thermoplastic properties such as a polyolefin, e.g. polyethylene or the like. The flexible sheet material can be present as a single layer or in form of a material comprising more than one layer, e.g. in form of a laminate.

FIGURES

FIG. 1 discloses a cross-sectional view of a first embodiment of the pouch of the present invention, wherein in A the pouch is shown in an open configuration, in B the pouch is shown in a first folded configuration, and in C the pouch is shown in a second folded configuration.

Figure 2:
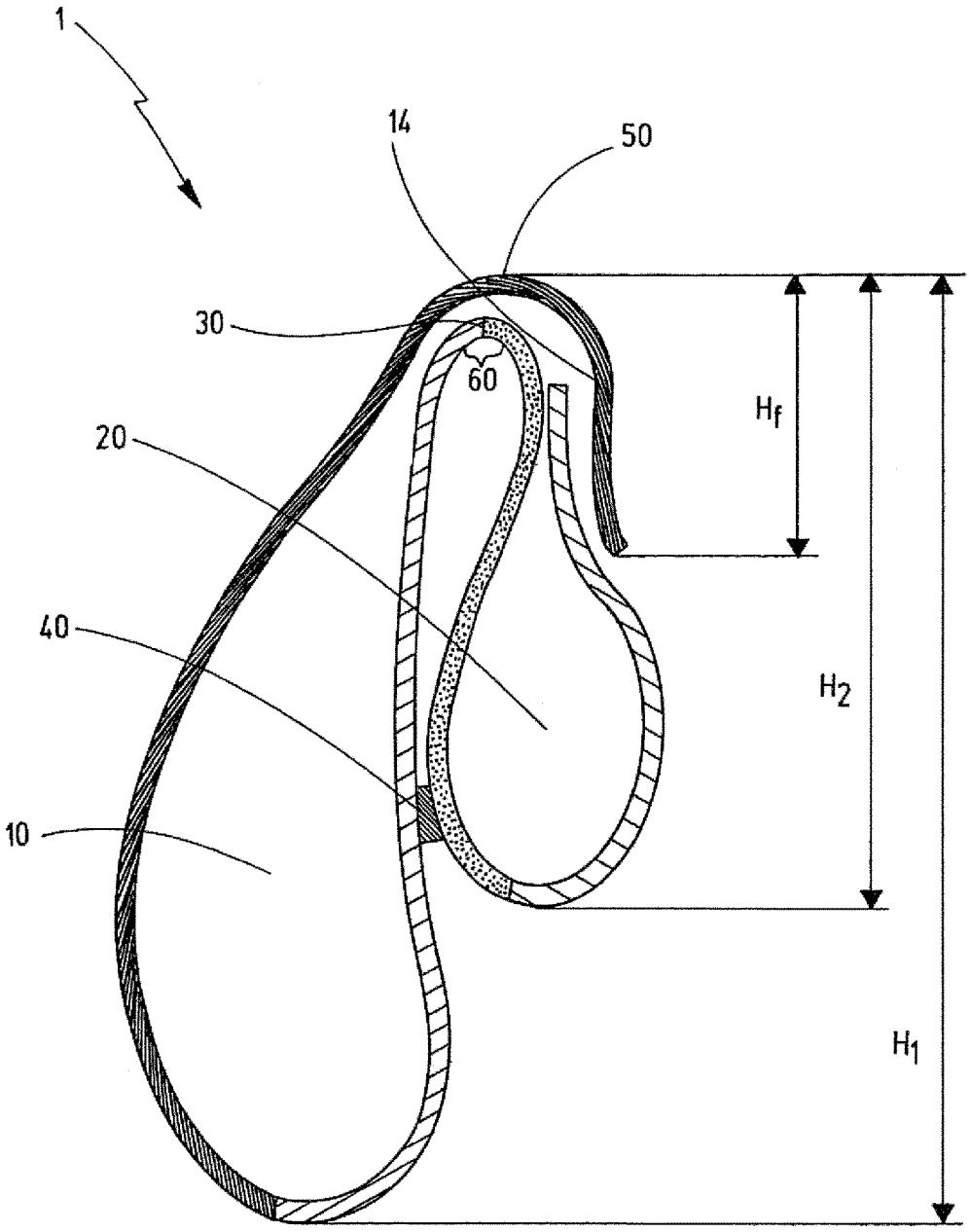

FIG. 2 discloses a cross-sectional view of a second embodiment of the pouch of the invention in a folded configuration.

EXAMPLES

FIG. 1 shows a cross-sectional view of a first embodiment of the pouch of the invention. In FIG. 1A a pouch 1 for tobacco is depicted in open configuration, wherein the pouch 1 comprises revertable pockets.

The pouch 1 comprises a first pocket 10. The first pocket 10 exhibits a front wall 11, a back wall 12, a first opening 13 allowing access to the interior of the first pocket 10 and a flap 14, wherein the flap 14 is formed of an elongated part of the back wall 12. The flap 14 is configured to close the first opening 13. The first pocket 10 further comprises a first releasable adhesive means 40 on the front wall 11. Optionally, first pocket 10 can also include a temporary seal 15, which may be resealable or not, arranged to seal the first opening 13.

The pouch 1 further comprises a second pocket 20. The second pocket 20 comprises a front wall 21, a back wall 22, and a second opening 23 allowing access to the interior of the second pocket 20. Optionally, second pocket 20 can also include a temporary seal 25, which may be resealable or not, arranged to seal the second opening 23.

In the pouch 1 of FIG. 1, the first pocket 10 and the second pocket 20 are connected to each other along a reverting line 30 such that the first pocket 10 and the second pocket 20 are foldable relative to each other along said reverting line 30. The first pocket 10 and the second pocket 20 are connected to each other such that the first opening 13 and the second opening 23 are aligned to neighbor each other and are both closable by the flap 14 of the first pocket 10 when the front walls 11, 21 of the first and the second pocket 10, 20 oppose each other. In such an arrangement, first and second openings 13, 23 are oriented in parallel to each other and are accessible independently from each other from the same direction. In this embodiment, the first pocket 10 and the second pocket 20 are connected via a base 60 bridging an edge portion of the front walls 11, 21 of the first and second pocket 10, 20 defining the first and second opening 13,23 respectively. The reverting line 30 is located at the connection between the front wall 11 of the first pocket 10 and the front wall 21 of the second pocket 20.

In FIG. 1 B the pouch 1 of FIG. 1A is shown in a first folded configuration. The pouch 1 has been folded along the reverting line 30 such that the back wall 12 of the first pocket 10 opposes the back wall 22 of the second pocket 20. In this configuration, the outer surfaces of the back walls 12, 22 face each other and, to the extent covered by one another, are not visible to the consumer. The outer surfaces of the front walls 11 and 21 of the first and second pocket 10, 20 are exposed and visible to the consumer. In order to stabilize this folding configuration, the pouch 1 may optionally comprise a second releasable adhesive means 42 on at least one of the back walls 12, 22 of the first and/or the second pocket 10, 20 in order to allow releasable fixing the back walls 12, 22 of the first and second pocket 10, 20 in a position opposing each other.

In FIG. 1C the pouch 1 of FIG. 1A is shown in a second folded configuration. The pouch 1 has been folded along the reverting line 30 such that the front wall 11 of the first pocket 10 opposes the front wall 21 of the second pocket 20. In this configuration, the outer surfaces of the front walls 11, 21 face each other and, to the extent covered by one another, are not visible to the consumer. Now, the outer surfaces of the back walls 12 and 22 of the first and second pocket 10, 20 are exposed and visible to the consumer. In order to stabilize this folding configuration, the pouch 1 comprises a first releasable adhesive means 40 on at least one of the front walls 11,21 of the first and/or the second pocket 10, 20 in order to allow releasable fixing the front walls 11, 21 of the first and second pocket 10, 20 in a position opposing each other.

Depending on the folding configuration, the consumer is confronted with different outer surfaces of the pouch which allows for multiple options with regard to communication with the consumer.

FIG. 2 shows a second embodiment of the pouch of the invention. The basic composition of the pouch 1 of FIG. 2 is the same as the one for the pouch 1 of FIG. 1. Thus, in the following only those features are described in further detail which are shown in FIG. 2 for the first time. Pouch 1 of FIG. 2 differs from pouch 1 of FIG. 1 in that the height H1 of the first pocket 10 exceeds the height H2 of the second pocket 20 and the height H2 of the second pocket 20 exceeds the height Hf of the flap 14 of the first pocket 10. The Heights H1, H2 and Hf are measured from the upper tip 50 of the folded pouch 1 to the bottom of the first pocket 10 for height H1, from the upper tip 50 of the pouch 1 to the bottom of the second pocket 20 for H2 and from the upper tip 50 of the pouch 1 to the distal end of the flap 14 for height Hr. By doing so, the pouch 1 exhibits a stepped appearance. When regarded from the side facing the second pocket 20, the pouch 1 reveals a two-stepped surface which allows for various design options for communication with the consumer.

The invention claimed is:

1. A pouch for tobacco with revertable pockets, wherein the pouch comprises:

a first pocket comprising a front wall, a back wall, a first opening and a flap formed by an elongated part of the back wall to close the first opening;

a second pocket comprising a front wall, a back wall and a second opening;

wherein the first pocket and the second pocket are connected to each other along a reverting line such that the first pocket and the second pocket are revertably foldable relative to each other along said reverting line between a first position, in which the front wall of the first pocket and the front wall of the second pocket are positioned adjacent and opposed to one another, and a second position, in which the back wall of the first pocket and the back wall of the second pocket are positioned adjacent and opposed to one another;

wherein the pouch further comprises one or more first releasable adhesive means on at least one of the front walls of the first pocket or the second pocket to allow releasably fixing the front walls of the first pocket and the second pocket in a position opposing each other;

wherein, with the first and second pockets in the first position, the flap is positioned over both the first opening and the second opening to close the first and second pockets;

wherein the first pocket and the second pocket are connected such that the first opening and the second opening are aligned to each other and are both closable by the flap of the first pocket when the front walls of the first pocket and the second pocket oppose each other; and wherein the first pocket or the second pocket comprises a temporary seal to close the first opening or the second opening.

2. The pouch of claim 1, wherein the flap comprises closing means to releasably close the first opening, the second opening or both the first and second openings, when the front walls of the first pocket and the second pocket oppose each other.

3. The pouch of claim 2 further comprising openings, pockets or flaps which are either exposed or covered by reverting the first pocket and the second pocket relative to each other.

4. The pouch of claim 3 further comprising one or more second releasable adhesive means on at least one of the back walls of the first pocket or the second pocket to releasably fix the back walls of the first pocket and the second pocket in a position opposing each other.

5. The pouch of claim 4, wherein the flap has a height which does not exceed at least one of a height of the first pocket or a height of the second pocket.

6. The pouch claim 5, wherein the height of the first pocket exceeds the height of the second pocket, and the height of the second pocket exceeds the height of the flap.

7. The pouch of claim 5, wherein the height of the first pocket equals the height of the second pocket.

8. The pouch of claim 3, wherein the first releasable adhesive means comprises at least one of a hook-and-loop/velcro fastener, a press-button, a snap-fastener and a releasable adhesive.

9. The pouch of claim 8, wherein the first releasable adhesive means comprises a pressure sensitive adhesive.

10. The pouch of claim 3, wherein the first and second openings are closable by sealing the flap of the first pocket against an outside surface of the pouch by sealing the flap of the first pocket against an outside surface of the back wall of the second pocket.

11. The pouch of claim 3, wherein the first and second pocket are formed of a single blank.

* * * * *